US005111179A

United States Patent [19]

Flassayer et al.

[11] Patent Number: 5,111,179

[45] Date of Patent: May 5, 1992

[54] CHIP FORM OF SURFACE MOUNTED ELECTRICAL RESISTANCE AND ITS MANUFACTURING METHOD

[75] Inventors: Claude Flassayer, St Laurent du Var, France; Franklin Collins, Lewiston, N.Y.

[73] Assignee: Sfernice Societe Francaise des l'Electro-Resistance, Paris, France

[21] Appl. No.: 600,819

[22] Filed: Oct. 22, 1990

[30] Foreign Application Priority Data

Oct. 20, 1989 [FR] France ..... 89 13759

[51] Int. Cl.[5] ..... H01C 1/012

[52] U.S. Cl. ..... 338/313; 338/272; 338/307; 338/308; 338/309

[58] Field of Search ..... 338/306-314, 338/227, 272, 22 R; 29/620, 621, 610.1; 361/540; 428/198, 209, 901

[56] References Cited

U.S. PATENT DOCUMENTS

| | | | |
|---|---|---|---|
| 3,496,513 | 2/1970 | Helgeland | 338/308 |
| 3,517,436 | 6/1970 | Zandman et al. . | |
| 4,267,634 | 5/1981 | Wellard | 29/620 |
| 4,318,072 | 3/1982 | Zandman | 338/314 X |
| 4,529,960 | 7/1985 | Uchida et al. | 308/309 |
| 4,684,916 | 8/1987 | Ozawa | 338/308 |
| 4,746,895 | 5/1988 | Kato et al. | 338/272 |
| 4,780,702 | 10/1988 | Snel et al. | 338/308 |
| 4,788,523 | 11/1988 | Robbins | 338/309 |
| 4,792,781 | 12/1988 | Takahashi et al. | 338/307 |
| 4,814,947 | 3/1989 | Gunter | 361/540 |
| 4,829,553 | 5/1989 | Shindo et al. . | |
| 4,924,205 | 5/1990 | Caporali et al. | 338/227 |
| 4,927,697 | 5/1990 | Ihill | 428/198 |
| 4,992,771 | 2/1991 | Caporali et al. | 338/22 R |

FOREIGN PATENT DOCUMENTS

| | | |
|---|---|---|
| 0191538 | 8/1986 | European Pat. Off. . |
| 2187598 | 9/1987 | United Kingdom . |

*Primary Examiner*—Marvin M. Lateef
*Attorney, Agent, or Firm*—Young & Thompson

[57] ABSTRACT

The chip form electrical resistance is designed to be soldered notably on a printed circuit card or on an hybrid circuit substratum. It includes an electrically insulating substratum (1) of the ceramic type, to which is attached by a layer of adhesive organic resin (2) a sheet of metal or of resistive alloy (3) which is engraved to provide a sinuous resistance. The layer of resin (6) leaves in the area of the two opposite sides of the substratum (1), two free areas (5), at the extremities of the engraved resistive sheet (3). These two parts (5) of the resistive sheet are each covered by a thin layer (8) of a metal or alloy adhering to the resistive sheet (3), this layer (8) being covered by a second thicker layer (9) of metal or conductive alloy, and this second layer (9) being covered by a third, also thicker layer (14) of a solderable metal, these three superimposed layers (8, 9, 14) spreading equally over both lateral sides opposite the substratum (1) and partially on its face (13) opposite the engraved resistive sheet (3).

12 Claims, 4 Drawing Sheets

FIG_1
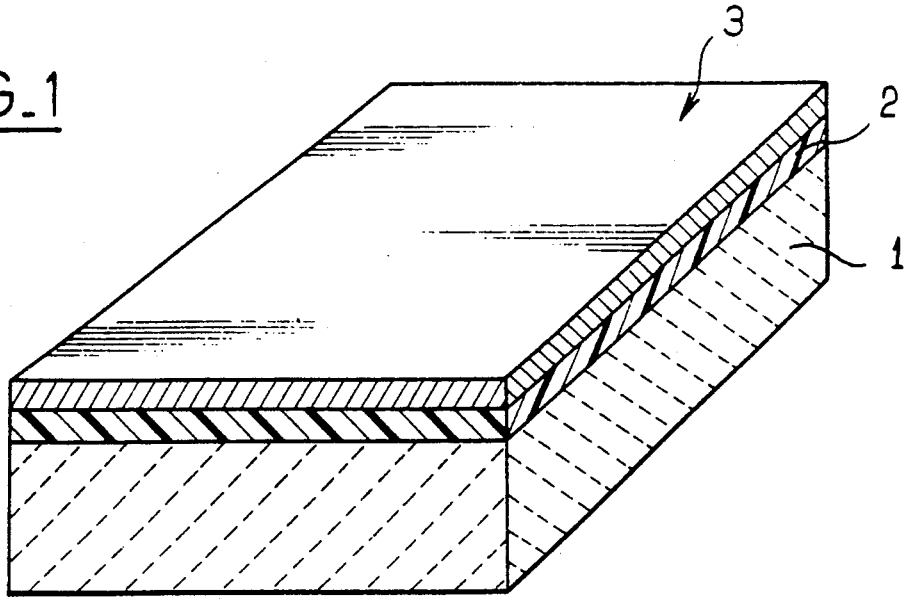
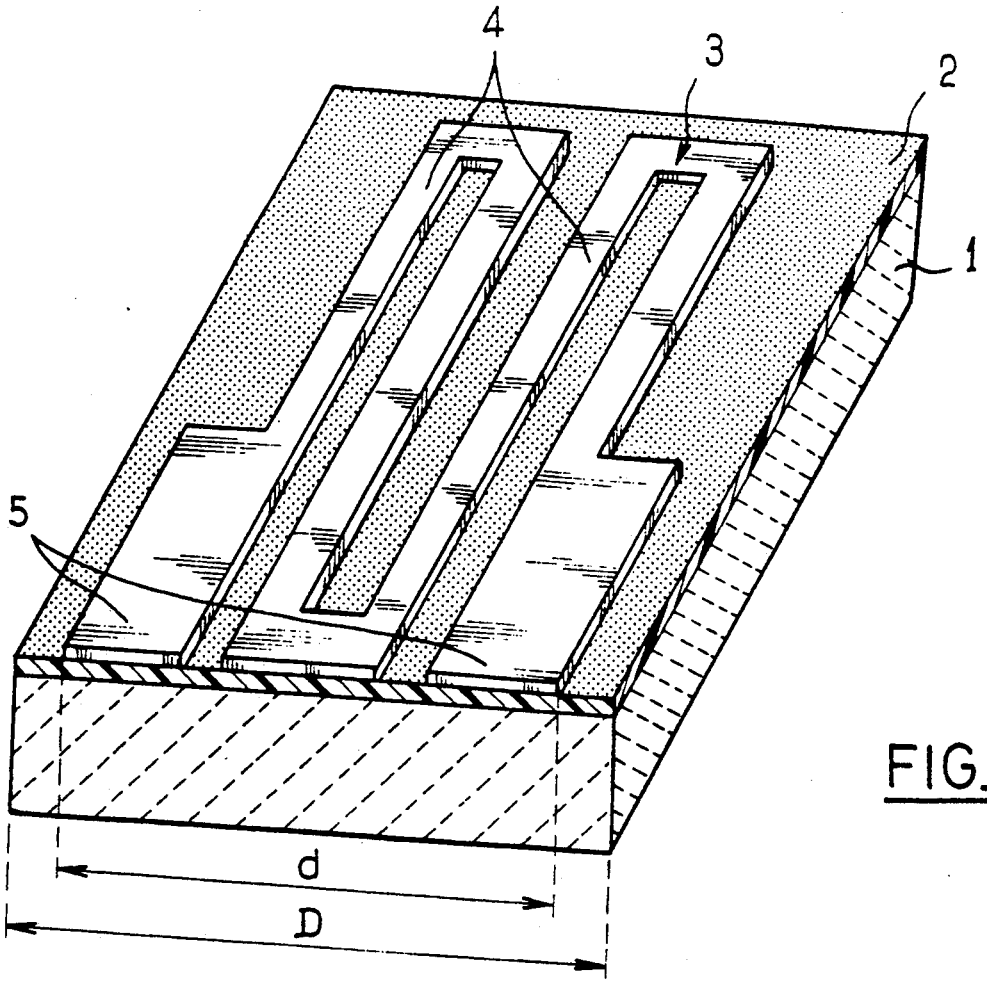
FIG_2

CHIP FORM OF SURFACE MOUNTED ELECTRICAL RESISTANCE AND ITS MANUFACTURING METHOD

FIELD OF THE INVENTION

This invention is a wireless electrical resistance chip, adapted in such a way as to be soldered eventually on a printed circuit card or an hybrid circuit substratum. Such a resistance is part of a new family of new components for electronics, generally known under the specific term of surface mounting components.

This invention is also concerned with the fabrication of this electrical resistance.

BACKGROUND OF THE INVENTION

We know how to manufacture resistance chips in such a way as to form a resisting element or resistive layer applied on an electrically insulated substratum in a square or rectangular shape of a few square millimeters.

The laying of this resisting element is realized by silkscreen printing with pastes or resisting inks layed directly on this substratum. The thickness of the layer applied is in the order of several micrometers and its electrical resistance varies between few ohms and several megaohms. This technique is known by people in the field under the specific term of deposit in thick layers. We also know how to manufacture the same type of components by layering by vacuum depositing technique of resisting materials notably of the chromium-nickel type or Constantan directly on the said substratum. Under these conditions, the ohmic value of the component so realized may vary between few ohms and few tens of kiloohms, the thickness of the layer varying typically between 10 and few thousand nanometers. This technique is known under the specific term of vacuum depositing. The extremity electrodes of these known resistances are made according to techniques of layering by thick layers, notably by deposit of Ag-Pd alloys on the substratum, done in such a way as to form an electrical continuum with the resisting material and by recharging later by electrolytic techniques the said Ag-Pd alloy with thick nickel, Sn and Pd-Sn layers.

The fabrication of these resistances in chips according to the depositing in thick or thin layers is realized by forming the resisting layer on a large insulating substratum, in the order of few tens of square centimeters and by dividing later the substratum by sections in comb or strip shapes. The resisting element or resistance layer is protected by a protective layer of organic matter of the photoresist type. The extremity electrodes are formed on the top of the component and the whole is treated at high temperature in order to give to the said electrodes an as weak as possible conductibility as well as a good mechanical hold.

Each of the sections in strip shape is then cut in units of a few square millimeters and finally an electrolytic deposit of Ni and Pb-Sn or equivalent is applied on each chip. This way, we obtain a resistance in the form of a surface mounted chip.

This process is described for example in the DE-A-3 148 778, the U.S. Pat. No. 4,278,706, the EP-A-0 191 538 and the U.S. Pat. No. 4,792,781.

The resistances manufactured by these known processes present however the disadvantage, by their nature, not to be precise and to have characteristical temperature and response variations in frequency prejudicial to the performances expected today for electronic circuits.

Indeed, the tolerances in ohmic value of these resistances are seldom lower than few per cent of the nominal value of the resistance. Also, their temperature coefficient, represented by the variation of the nominal resistance according to the temperature is never lower than 100 to 200 parts per millions/degree Celsius (ppm/°C.).

Moreover, the variations of the nominal resistance with time, can be between few thousands and serveral thousands parts per million (ppm).

BRIEF SUMMARY OF THE INVENTION

The object of the present invention is to compensate for these inconveniences by making a resistance chip for surface mounting with an ohmic value tolerance in relation to the nominal value in the order of 0.1% to 0.05%.

Another object for this present invention is to realize a resistance chip with a temperature coefficient inferior to 5 ppm/°C.

Another object of the present invention is to realize a resistance chip with a nominal variation of resistance in time limited between 50 and 200 ppm for a duration of between 2000 and 10,000 hours at 155° C.

Another object of this present invention is to realize a resistance chip having all the advantages described above, while keeping the properties of soldering and reliability generally associated with very high precision components.

Another object of the present invention is to provide a method permitting to manufacture a resistance chip which presents the above defined characteristics.

The invention thus concerns an electrical resistance chip, intended to be soldered notably on a printed circuit card or on an hybrid circuit substratum of the electrically insulating ceramic type, on which is joined by an adhesive layer of organic resin, a sheet of metal or a resisting alloy, such a sheet being cut-out by engraving to form filaments connected together to constitute a meandering resisting circuit. This cut-out resisting sheet is covered by another layer of organic resin.

According to the invention, this resistance is characterized in that the aforementioned other layer of resin leaves free on both opposite sides of the substratum two extremities of the cut-out resisting sheet, in that these two parts of the resisting sheet are each covered by a thin layer of a metal or alloy sticking to the resisting sheet, this layer being covered by a second thicker layer of metal or conducting alloy; and this second layer being also covered by a third thicker layer of a soldering alloy, these three superimposed layers are equally spread out on both opposite lateral sides of the substratum and partially on the face of the substratum which is opposite to the cut-out resisting sheet.

The three successive metallic layers covering the two extremities of the resisting sheet, as well as the lateral opposite sides of the substratum and part of the face of the substratum opposite to the one holding the resisting sheet, permit to establish an electrical connection between the resisting element (the engraved sheet) and notably an hybrid or printed circuit.

The invention allows thus to realize a chip form of resistance being surface mounted, and having a resisting element a metallic sheet being engraved instead of a resisting layer obtained following the technique of thick or thin layers.

The tests performed by the applicants have shown that such a resistance presented at least the following characteristics:

temperature coefficient inferior to 10 ppm per °C.,
Ohmic value tolerance inferior to 0.01%,
variation of this value with time inferior to 1000 ppm at 155° C. and 10,000 hours.

According to a preferred version of this invention, the said extremity parts of the resisting cut-out sheet do not spread up to the two lateral opposite sides of the substratum but leave free two of the opposite zones adjacent to the said lateral faces of the substratum in such a way that the three metallic layers successively recover on each side of the resistance, a part of the cut-out resisting sheet, then a section of the substratum not covered by the said resisting sheet and bare of resin, then, successively the lateral side of the substratum and part of the surface of the substratum opposite to that which bears the resisting sheet.

The tests done by the applicants have shown that in this case, the resistance presented the following performances:

temperature coefficient below 5 ppm per °C.,
Ohmic value tolerance below 0.005%,
variation of this value in time below 500 ppm at 155° C. and for 10,000 hours.

According to another aspect of the invention in the manufacturing method of the electrical resistance, on the substratum is glued a resisting metallic sheet with a resin, the said resisting sheet is engraved (or etched) in order to form a sinuous contoured resisting filament presenting extremity parts intended for the electrical connections of the resistance, we apply on the said engraved sheet, a second layer of resin, such a process being characterized by the following steps:

removing by engraving the said second layer of resin on the said extremity parts of the engraved sheet fot the electrical connections, applying on the said extremity parts of the engraved sheet not covered by the resin, a metallic coating spread on each of the lateral sides of the substratum and in part on the side of the substratum opposite to the side holding the engraved sheet, this metallic coating being formed by the following successive layers, a thin layer of chromium or titanium-tungsten alloy, a thicker layer of a nickel-chromium alloy, then a layer of nickel or gold.

Other particularities and advantages of the invention will appear in the following description:

To the annexed drawings given as examples, but not to be limited to them:

BRIEF DESCRIPTION OF THE DRAWINGS

FIG. 1 is a perspective view of the sheet glued on its substratum, and constituting the first step of the process as given in the invention, FIG. 2 is a perspective view of the resistance after engraving of the sheet.

DESCRIPTION OF THE PREFERRED EMBODIMENTS

Figure 3:
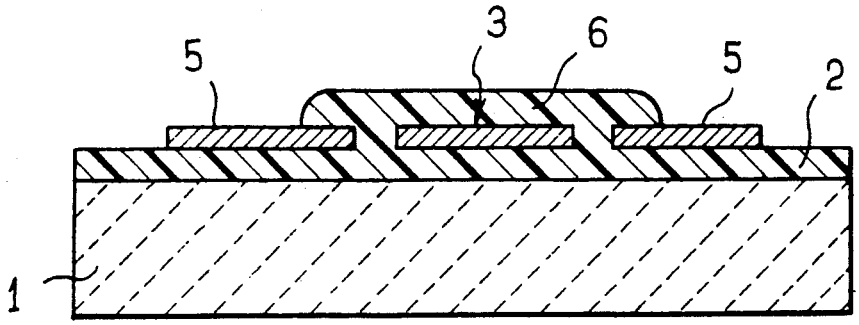
FIG. 3 is a cross-sectional view of the resistance after protection of the sheet by an engraved layer of resin.

The resistance chip according to the invention is formed by the following elements (see also FIGS. 6 and 7):

1. An insulating substratum 1 of a ceramic type, preferably but not restricted to aluminum oxyde, 0.2 to 0.6 mm thick and measuring 2 to 3 mm in width precising that these dimensions are not restrictive and may vary in large proportions depending upon the constraints imposed by the electrical power dissipated by the resistance or all other constraints, size or mechanical in connection with the characteristics of the circuits using these resistances.

2. An adhesive layer 2 of the resin epoxy type or other matter presenting good adhesive properties as well as good mechanical and electrical hold under the thermic, chemical and mechanical constraints laid upon the said ceramic substratum, and designed to affix permanently a sheet of metal or resistive alloy 3 on the substratum 1.

3. A resistive metal sheet 3 constituted of Ni-Cr alloy or other matter presenting the same characteristics of resistance as Ni-Cr, 2 to 10 micrometers thick, glued on the ceramic substratum 1 and engraved through a photoresistant mask in the shape of conducting filaments, presenting a continuous Greek design fret, controlled in width and length with extreme precision. The resistive metal sheet 3 is then protected by a layer 6 of resin (epoxy or the like) of the same nature as the gluing layer 2 between the ceramic 1 and the sheet 3. This technology of fabrication, designed notably to make electrical resistances, has been described in the U.S. Pat. Nos. 3,405,589 and 3,517,436 ZANDMAN, as well as in the French patents 2 344 940 and 2 354 617 of the applicant. This process produces extremely stable and precise electrical resistances.

4. A thin and extremely adhesive layer 8 of metal or of chromium or nickel-chromium alloy, deposited around the edges of the substratum 1 and in intimate electrical and mechanical contact with the resistive metal sheet 3 glued on the substratum 1.

5. A thick sheet 9 of metal or conductive alloy such as nickel, covering the thin film 8 in order to render electrical contact as conductive as possible and permitting a good metallic base for later soldering.

6. A thick layer 14 of soldering alloy of the tin-lead type covering the whole of the layers of nickel or chromium or of nickel-chromium, permitting to solder on printed or hybrid circuits the resistance under the best of conditions.

We will first describe in references to FIGS. 1 to 6 the manufacturing process of the preferred version of a resistance chip in accordance with the invention.

First step (FIG. 1), a resin 2 (for example epoxy or polyimide or any other type of glue which can tolerate the mechanical and thermic constraints), is used to glue a sheet 3 of nickel and chromium alloy of a thickness varying between 2 and 10 micrometers, on an insulating substratum 1 (for example, made of ceramic of the aluminum oxyde, beryllium oxyde, or aluminum nitrate or anyother ceramic whith good dielectrical properties at all temperatures as well as excellent hardness and mechanical strength properties) of a thickness varying between 0.2 and 0.6 mm and a surface of 0.5 to a few square millimeters.

In a second step, using the traditional means of photolithography and well known in the microelectronic industry, the sheet 3 is applied on a photoresistant mask, bearing openings showing a resistance pattern similar to those described in the patents mentioned above.

In a third step, the whole is brought to a chemical, electrochemical or ionic machining, as described for example in the U.S. Pat. Nos. 3,517,436 and 3,405,389 (ZANDMAN) in the French Patents 2 344 940 and 2 354 617 of the applicant, in order to engrave the parts of the resistive sheet 3 not protected by the photoresistor.

After removal of the photoresistor, the whole substratum 1 and sheet 2 look like the sketch presented on FIG. 2, in which the reference 4 represents schematically the resistance as an engraved filament folded in a greek shape fret with, at its extremities shaped during the same process of photoengraving, the exit segments 5, designed to connect the resistance on the outside, the entire section closely adhering to the substratum 1 by the layer of resin 2. The engraving mask has been designed so that the lateral dimension d of the resistive element 3, 4 and 5 is sensibly smaller than the width D of the substratum 1 and is between 0.8 D and 0.6 D. Thus, there remain on each side of the extremity parts 5 of the engraved sheet 3 some free areas.

In a fourth step, represented by FIG. 3, the active part of the resistance 3 is protected by a thick protective layer of resin 6 preferably of identical nature to layer 2, or of a polyimide type in order to bring a long lasting protection against humidity and corrosion.

The lateral dimension of this protection area is sensibly smaller than d, in order to leave free as much as possible of the contact areas 5. This resin layer 6 is applied by silkscreen printing or other process.

In a fifth step, a thick layer (in the order of 5 to 10 micrometers) of photoresist is used to protect the parts 6 and 5, so that it also leaves exposed the lateral sides 7 of the resistance, covered by the layer 2 of the gluing resin.

Figure 4:
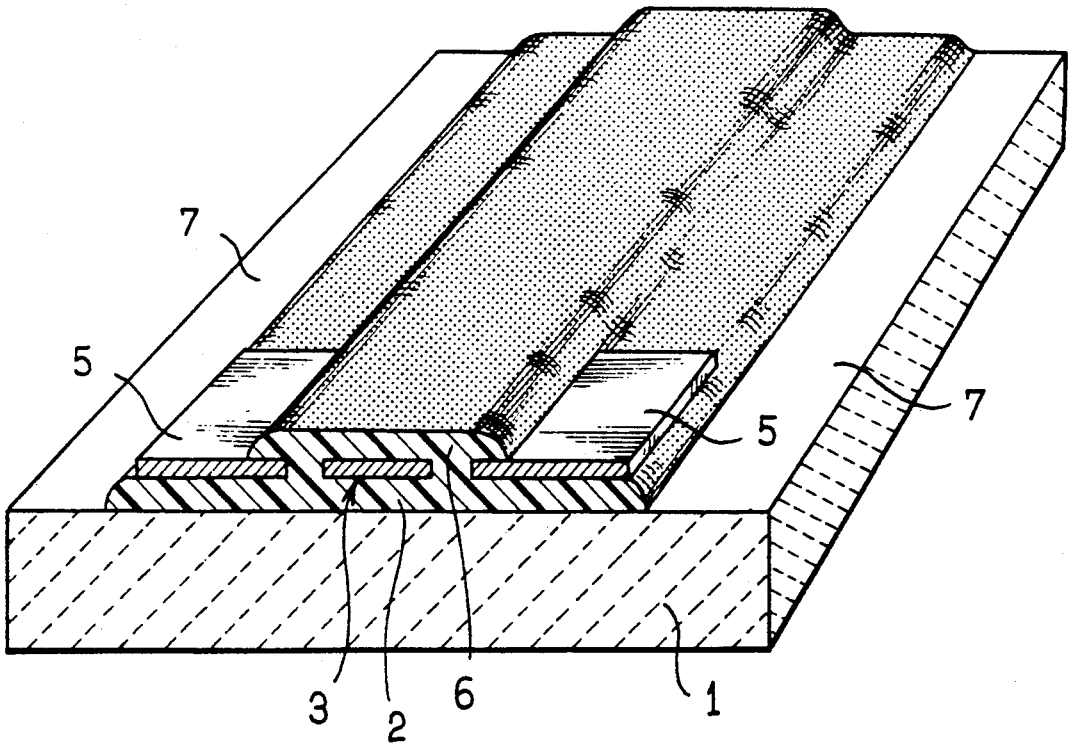
FIG. 4 is a view in perspective illustrating the fourth step of the manufacturing process: preferential engraving of the gluing resin layer of the sheet, along the edges of the said resistance.

The section of the layer of resin 2, not protected by the photoresist is then removed by etching. One of the preferred means of the invention, is to submit the whole of the resistance to a plasma formed by a mixture of oxygen and gaseous fluorized compounds of the carbon fluoride type. The engraving speed of the plasma being substantially equal for the photoresistant and for the resin 2, the result of this process, presented by FIG. 4, is to leave bare and perfectly free of any trace of resin, the adjacent sections on both opposite sides of the substratum 1.

Figure 5:
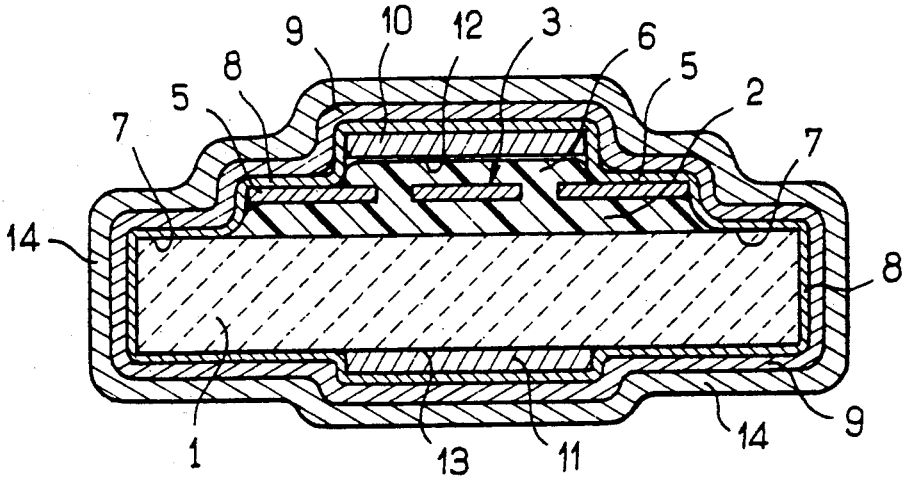
FIG. 5 is a cross-sectional view illustrating the fifth and sixth steps of the manufacturing process: the application of the thin layer of Ni-Cr or Cr by vacuum application and application of the Nickel layer by electrolytic process.

The sixth step of the process, presented in FIG. 5, is to apply by vacuum process a thin layer 8 of chromium on the exit areas 5 of the resistive sheet 3 as well as on the lateral sides 7 of the substratum 1. One of the preferred methods of the invention is to deposit by cathodic sputtering, on the said areas and surfaces 5 and 7, first a chromium layer 8, of a thickness of between 10 and 50 nanometers, followed by a deposit 9 of a nickel-chromium alloy, at an atomic concentration of chromium varying between 20% and 50%, and a thickness between 500 and 1500 nanometers. The purpose of the deposit 8 is to form between the sheet 3 and the layer 9, an interface liable to give an excellent ohmic contact combined with good adhesive strength between the sheet 3 and the layer 9. A third layer of nickel or gold 14 is then applied. One of the preferred means of the invention is to use, to achieve the said deposit, the electrolytic techniques appropriate for metal and alloy applications. Another method preferred by the invention is to apply instead of the chromium layer 8, an alloy of the titanium-tungsten type, which allows a better mechanical pull with the sheet 3 than pure chromium. This layer covers also parts 7 all the while assuring a smooth transition between the exit areas 5 and the parts 7. This permits a maximum reduction of the mechanical and thermic constraints which may develop at the level of the areas 5 due to a dilatation coefficient difference between 1, 2 and 3. This optimization permits to guarantee that the value of the resistance chip will be practically constant in time and under temperature variations during its use. This phenomenon is further increased by the utilization of the cathodic pulverization method, which has the property of increasing the adhesive properties of thin layers deposited on the exit parts 5 and the substratum 1.

Before the deposition process, metallic masks 10 and 11 have been placed by appropriate mechanical means on the faces 12 and 13 of the resistance in order to protect them from all traces of chromium, nickel-chromium and of nickel or gold. The application is done to cover with a uniform layer all of the surfaces of the sheet 2 and of the substratum 1, protected or not protected by the metallic mask 10 and 11. After the vacuum-depositing and electrolytic processes, the metallic masks 10 and 11 are removed. This process removes mechanically the thin layers which became deposited on these masks. The result of this process is shown on FIG. 6. The layers of plating 8, 9 and 14 then form a stretched C shaped ohmic contact, electrically connecting the resistance to sheet 3 via the exit areas 5 to the lower surface 13 of the substratum.

When the connecting process with the remainder of the hybrid or printed circuit is realized by microsoldering using a gold or aluminum wire, the material forming the layer 14 is achieved by electrolytic gold plating.

When the chip resistance is intended to be soldered on the said printed circuit or the said hybrid circuit by tin-lead soldering, then, the layer 14 is made by electrolytic nickel plating. It is then covered by appropriate means of dipping in a tin-lead bath, of a tin-lead layer 5 to 20 micrometers thick.

Figure 6:
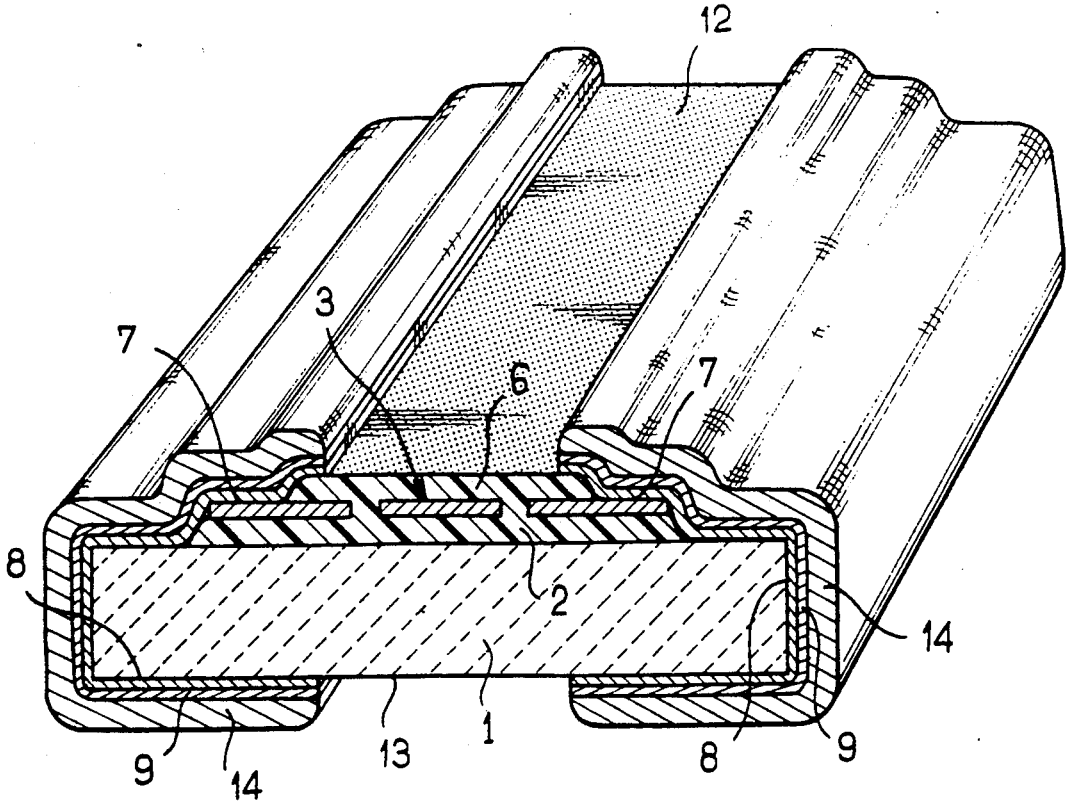
FIG. 6 is a view in perspective showing the final appearance of the resistance chip.
Figure 7:
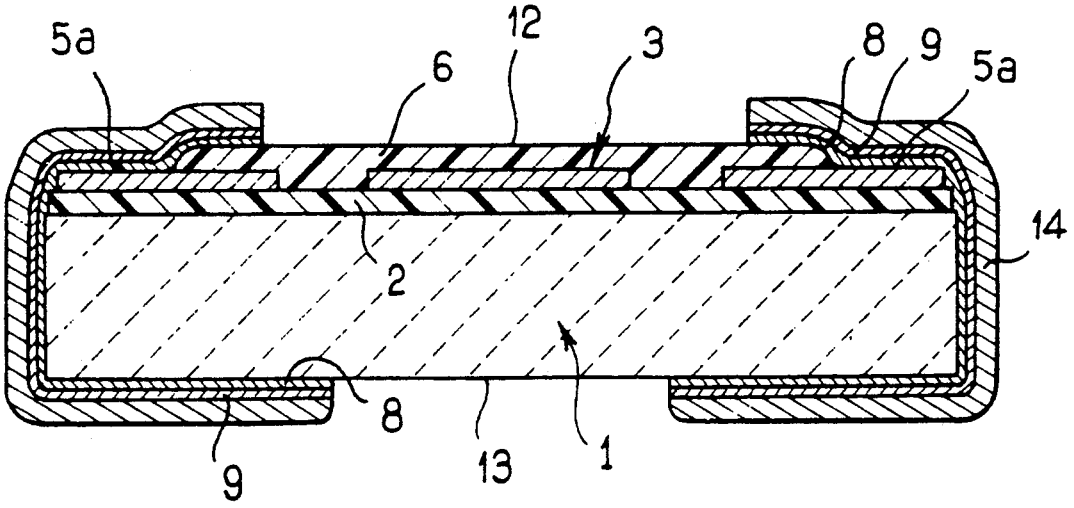
FIG. 7 is a cross-sectional view of an alternative realization of a resistance according to the invention.

In the realization shown on FIG. 7, parts 5*a* of the engraved resistive sheet 3 are spread out practically to opposite lateral edges of the substratum 1. This way, contrary to the realization shown on FIG. 6, there are no free segments between the edge of parts 5*a* and the adjacent edge of the substratum.

However, as in the realization shown on FIG. 7, parts 5*a* of the engraved resistive sheet 3 are covered by three metallic layers 8, 9, 14 identical to those shown on FIG. 6, which spread to the lateral sides of the substratum as well as on part of the face 13 of the substratum opposite to the side bearing the engraved resistive sheet 3.

As in the preferred realization and according to FIG. 6, these three metallic layers form a conductive coating in cross-section in the shape of a C, covering the entire length of compound on its two opposite sides.

The chip resistance thus obtained presents also performances superior to those resistances realized by the techniques of layer thick or thin, due to the great precision with which the resistive element 3 can be obtained in the form of a cut-out or engraved sheet.

However, the performances (temperature coefficient, ohmic value and variation tolerance) are inferior to those of a resistance of the one shown on FIG. 6).

The superiority of the resistance represented on FIG. 6 is essentially explained by the presence of free sections 7 included between the edges of the parts 5 of the resistive sheet 3 and the adjacent edges of the substratum 1 which allow as explained above, to reduce the thermic and mechanical constraints on the parts 5 of the engraved resistive sheet 3 due to the dilatation coefficient differences between the substratum 1, the resi layer 2 and the resistive layer 3.

Of course, the invention is not limited to the manufacturing examples just described and we may bring to these numerous modifications without leaving the parameters of the invention.

We claim:

1. In a chip form electrical resistance, designed to be soldered notably on a printed circuit card or on an hybrid circuit substratum, including an electrically insulating substratum (1) of the ceramic type, on which is combined by an adhesive layer or organic resin (2), a sheet (3) of metal or resistive alloy, this sheet being engraved in order to form filaments (4) connected together to constitute a sinuous resistive circuit, this resistive sheet (3), being covered by another layer (6) of organic resin; the improvement in which said another layer of resin leaves free near the two opposite sides of the substratum (1), two parts (5, 5*a*) at the extremity of the resistive sheet (3), these two parts (5, 5*a*) of the resistive sheet being each covered by a thin layer (8) of a metal or alloy adhering shape-matingly to the resistive sheet (3), said layer (8) of a metal or alloy being covered by a second thicker layer (9) of metal or conductive alloy, and said second layer (9) being covered by a third layer (14) also thicker of a solderable alloy, these three layers (8, 9, 14) being superimposed and extending equally and shapematingly over the two lateral and opposite sides of the substratum (1) and partially over the face (13) of the substratum opposite to the resistive sheet (3).

2. Resistance in accordance with the claim 1, wherein the resistive sheet (3) is of nickel and chromium alloy.

3. Resistance in accordance with the claim 1, wherein the first layer (8) is of chromium or titanium-tungsten alloy.

4. Resistance in accordance with claim 1, wherein the second layer (9) is of nickel-chromium alloy.

5. Resistance in accordance with claim 1, wherein the third layer (14) is of nickel or gold.

6. Resistance in accordance with claim 1, wherein said extremity parts (5*a*) of the cut-up resistive sheet (3) extend partially over the opposite lateral faces of the substratum (1).

7. Resistance in accordance with claim 1, wherein the said extremity parts (5) of the resistive sheet (3) do not extend to the two opposite lateral faces of the substratum (1) but leave two opposite free sections (7) of the substratum adjacent to the said lateral faces of the substratum, so that the said three metallic layers (8, 9, 14) cover successively on each side of the resistance, a part (5) of the resistive sheet (3), then a segment (7) of the substratum not covered by the said resistive sheet and layer of resin and successively the lateral face of the substratum (1) and part of the surface (13) of the substratum opposite to the side bearing the resistive sheet.

8. Resistance in accordance with claim 7, wherein the width (d) of the engraved resistive sheet (3) is between 0.8 and 0.6 times the width D of the insulating substratum (1).

9. In a method for manufacturing an electrical resistance, in which on an insulating substratum (1) is glued a resistive metallic sheet (3) by means of a resin (2), then the said resistive sheet (3) is engraved in order to form a resistive filament (4) with a sinuous contour presenting extremity parts (5, 5*a*) designed for the electrical connections of the resistance, to the sheet (3) so engraved is applied a second layer of resin (6); the improvement comprising the following steps:

removing by engraving the said second layer of resin (6) on the extremity parts (5, 5*a*) of the engraved sheet (3) designed for the electrical connections, applying on the said extremities (5, 5*a*) of the engraved sheet not covered by the resin, a metallic coating (8, 9, 14) extending shape-matingly over each of the lateral faces of the substratum (1) and in part over the face (13) of the substratum opposite the side bearing the engraved sheet (3), this metallic coating being formed by the successive layers as follows: a thin layer (8) of chromium or of titanium-tungsten alloy, then a layer (9) of nickel-chromium alloy, and then a layer of nickel or gold (14).

10. Method in accordance with claim 9, wherein at the time of the removal of the resin over the parts (5) of the engraved resistive sheet (3), this resin is removed over a segment (7) of the substratum (1) adjacent to each of its lateral sides.

11. Method in accordance with claim 9, wherein the first layer (8) made of chromium or of a titanium-tungsten alloy has a thickness between 10 and 50 nm and the second layer (9) of nickel-chromium alloy has a thickness between 500 and 1500 nm.

12. Method in accordance with claim 9, the resistance being designed to be soldered over a printed or hybrid circuit, the third layer (14) being made of nickel, wherein this third layer (14) is covered by a tin-lead alloy layer of between 5 and 20 nm thick.

* * * * *